United States Patent [19]

Reynolds et al.

[11] Patent Number: 4,778,590

[45] Date of Patent: Oct. 18, 1988

[54] DECALCIFICATION OF HYDROCARBONACEOUS FEEDSTOCKS USING AMINO-CARBOXYLIC ACIDS AND SALTS THEREOF

[75] Inventors: John G. Reynolds, El Cerrito; Thomas F. Finger, Crockett, both of Calif.

[73] Assignee: Chevron Research Company, San Francisco, Calif.

[21] Appl. No.: 901,344

[22] Filed: Aug. 28, 1986

Related U.S. Application Data

[63] Continuation-in-part of Ser. No. 792,716, Oct. 30, 1985, abandoned.

[51] Int. Cl.[4] ..... C10G 17/00

[52] U.S. Cl. ..... 208/252; 208/309; 208/251 R; 423/144; 423/150; 423/155; 423/165; 585/866

[58] Field of Search ..... 208/251 R, 309, 252; 423/144, 150, 155, 165; 585/866

[56] References Cited

U.S. PATENT DOCUMENTS

| | | | |
|---|---|---|---|
| 2,767,123 | 10/1956 | Hickok et al. | 208/251 R |
| 2,906,693 | 9/1959 | Donaldson | 208/251 R |
| 2,971,905 | 2/1961 | Bieker et al. | 208/252 |
| 2,972,577 | 2/1961 | Selbin | 208/251 R |
| 2,976,233 | 3/1961 | Selbin | 208/251 R |
| 3,095,368 | 6/1963 | Bieber et al. | 208/252 |
| 3,153,623 | 10/1964 | Eldib et al. | 208/251 R |
| 3,322,664 | 5/1967 | Paterson et al. | 208/251 R |
| 3,625,761 | 12/1971 | Tate | 423/155 |
| 4,280,897 | 7/1981 | Shah et al. | 502/25 |
| 4,431,524 | 2/1984 | Norman | 208/252 |
| 4,439,345 | 3/1984 | Duke | 252/330 |
| 4,539,099 | 9/1985 | Merchant et al. | 208/251 R |

FOREIGN PATENT DOCUMENTS

| | | | |
|---|---|---|---|
| 1642497 | 6/1962 | Canada | 208/252 |

*Primary Examiner*—Asok Pal
*Assistant Examiner*—Helane Myers
*Attorney, Agent, or Firm*—S. R. La Paglia; T. G. DeJonghe; Q. T. Dickinson

[57] ABSTRACT

A process is disclosed for the removal of metals contaminants, particularly calcium, from hydrocarbonaceous feedstocks. The process comprises mixing the feedstock with an aqueous solution of a metals sequestering agent, particularly amino-carboxylic acids, their salts, or mixtures thereof, more particularly EDTA, and separating the aqueous solution containing the metals from the demetalated feedstock.

9 Claims, 1 Drawing Sheet

DECALCIFICATION OF HYDROCARBONACEOUS FEEDSTOCKS USING AMINO-CARBOXYLIC ACIDS AND SALTS THEREOF

CROSS REFERENCE TO RELATED APPLICATIONS

This application is a continuation-in-part of U.S. Ser. No. 792,716, filed Oct. 30, 1985 now abandoned.

BACKGROUND OF THE INVENTION

This invention relates to a process for the removal of calcium from calcium-containing petroleum crudes, heavy hydrocarbonaceous residua, or solvent deasphalted oils derived from crudes and residua using amino-carboxylic acids, as sequestering or chelating agents. A few, but increasingly important, petroleum crude feedstocks and residua contain levels of calcium which render them difficult, if not impossible, to process using conventional refining techniques. The calcium contaminants causing particular problems are non-porphyrin, organometallically-bound compounds. These species have been only recently discovered in crude oils, very heavy crude oils in particular, and are apparently relatively rare. One class of these calcium-containing contaminant compounds identified, in particular, is the calcium naphthenates and their homologous series. These organocalcium compounds are not separated from the feedstock by normal desalting processes, and in a conventional refining technique they can cause the very rapid deactivation of hydroprocessing catalysts. Examples of feedstocks demonstrating objectionably high levels of calcium compounds are those from the San Joaquin Valley in California. Generally, these crudes are contained in a pipeline mixture referred to as San Joaquin Valley crude or residuum.

The problems presented by calcium in petroleum feedstocks and their necessity for removal have only been recently appreciated, and the prior art contains few references specifically to its removal. Metals removal using organic compounds generally, however, has been addressed in the prior art, specifically for the removal of known metallic contaminants, such as nickel, vanadium, and/or copper. These compounds are also ordinarily found in feedstocks as porphyrins, and other organometallic compounds.

In U.S. Pat. No. 3,052,627, Lerner, metals-contaminants are removed from crude petroleum feedstocks using a 2-pyrrolidone-alcohol mixture. In U.S. Pat. No. 3,167,500, Payne, metallic contaminants, such as metal-containing porphyrins, are removed from petroleum oils using a condensed polynuclear aromatic compound having a preferred C/H ratio and a molecular weight, ordinarily called pitch binders. In U.S. Pat. No. 3,153,623, Eldib et al., selected commercially available organic compounds of high dielectric strength were added to assist in the electrically-directed precipitation removing metals with the polar organic molecules.

It has now been unexpectedly found that the calcium-containing contaminants may be effectively removed from hydrocarbonaceous feedstocks by binding the calcium compounds using amino-carboxylic acids and their salts.

SUMMARY OF THE INVENTION

The process comprises a method for demetalating hydrocarbonaceous feedstocks, particularly crude petroleum or residua, using an aqueous solution of a chelating agent. The method is particularly appropriate for removing calcium, especially non-porphyrin, organically-bound calcium compounds. The preferred metal chelating agents are amino-carboxylic acids, such as nitrilotriacetic acid, N-(hydroxyethyl)ethylene diamine triacetic acid, and diethylene triamine pentaacetic acid, their salts, or mixtures thereof in an aqueous solution.

In a preferred process, the feedstock to be demetalized is intimately and thoroughly mixed with an aqueous solution of the amino-carboxylic acid and its salt. The metals complex with the agent in the aqueous phase because the resulting complexes are water soluble. The aqueous phase and the hydrocarbon phase are then separated, and the hydrocarbonaceous feedstock is then available for hydroprocessing.

DETAILED DESCRIPTION OF THE INVENTION

Figure 1:
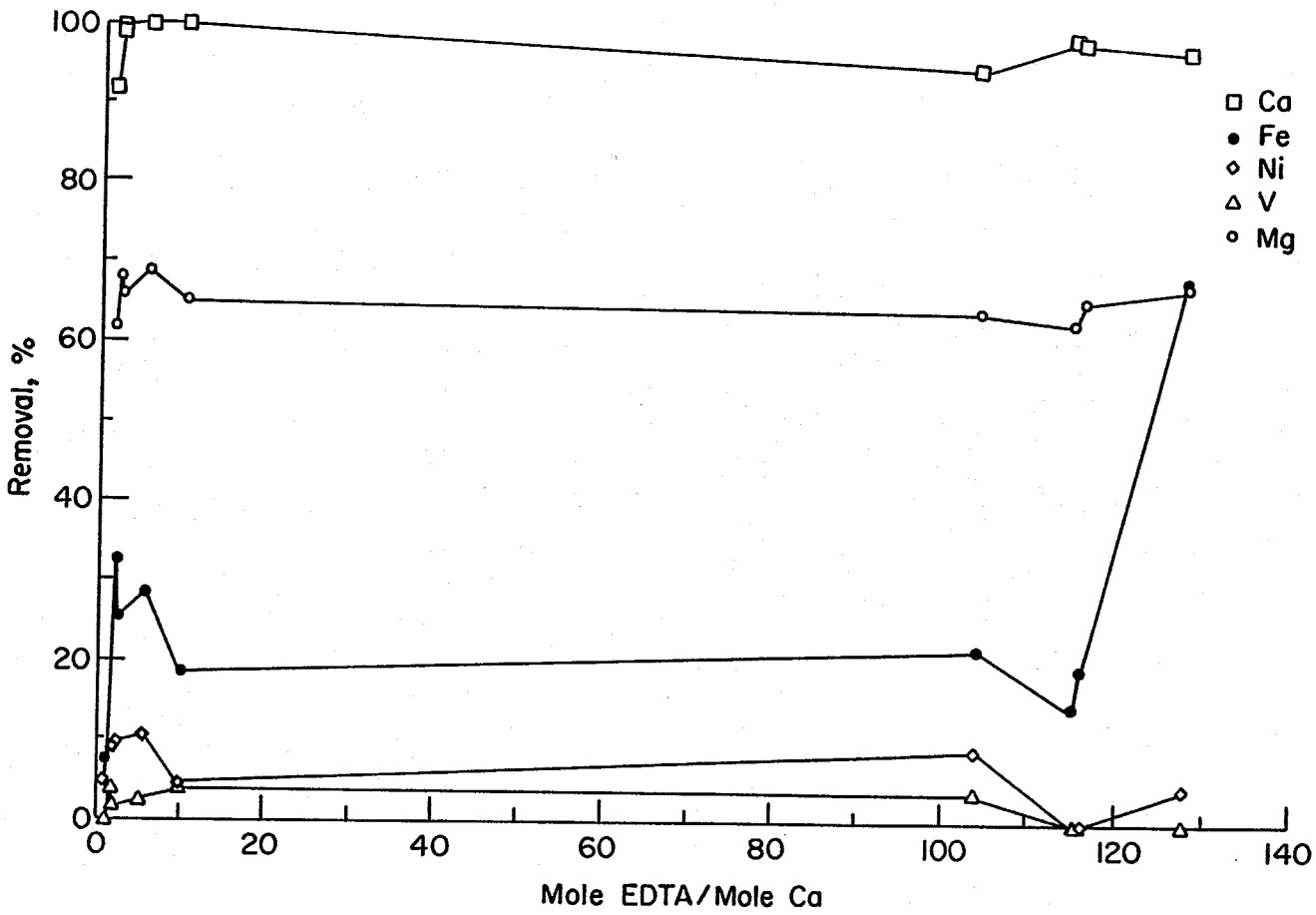

Various petroleum crude feedstocks and residua produced from them contain unacceptably high levels of calcium-containing contaminants. These calcium ions, especially organically bound, or calcium-containing compounds cause distinct processing difficulties in standard hydroprocessing techniques, ordinarily by the rapid deactivation or fouling of the hydroprocessing catalyst. This invention comprises a method for removing those calcium-containing contaminants prior to hydroprocessing of the crude or residua by using known chelating agents, known as amino-carboxylic acids and salts thereof.

The invention can be applied to any hydrocarbonaceous feedstock containing an unacceptably high level of calcium. Those feedstocks can include crude petroleum, especially from particular sources, such as San Joaquin Valley crude, including, for example South Belridge, Kern Front, Cymric Heavy, Midway Sunset, and Shengli from China or mixtures thereof. Additionally, atmospheric or vacuum residua or solvent deasphalted oils derived from these crudes and residua also have unacceptably high calcium levels. It is within the contemplation of the invention that any other hydrocarbonaceous feedstocks, such as shale oil, liquefied coal, beneficiated tar sand, etc., which may contain calcium contaminants, may be processed using this invention.

The basic process is relatively simple: The crude or residuum desired to be processed is mixed with an aqueous solution of the amino-carboxylic acid, a salt thereof or mixtures thereof, and a base for adjusting the pH above 2, and preferably between 5 to 9. The calcium is readily bound or chelated to the acid anion to form a complex. This calcium/amino-carboxylate complex is ionic, and is therefore soluble in the aqueous phase of the mixture. The two phases, the aqueous and the crude or hydrocarbonaceous phase, are separated or permitted to separate. The aqueous solution containing the calcium contaminant is removed, resulting in a calcium-free hydrocarbon feed which then can be handled in the same manner as any other carbonaceous feed and processed by conventional hydroprocessing techniques. It is contemplated that the physical separation process is ordinarily to be done in a conventional crude oil desalter, which is usually used for desalting petroleum crudes prior to hydroprocessing. The separation may be done by any conventional separation process, however, and may include countercurrent extraction.

It is well known that amino-carboxylic acids have a high affinity for calcium and other metal ions. Known as chelating agents, common examples of these amino-carboxylic acids include: nitrilotriacetic acid (NTA), $C_6H_9NO_6$, molecular weight 191.14, also known as N,N-bis(carboxymethyl)glycine, triglycollamic acid, or triglycine; N-(hydroxyethyl)ethylene diamine triacetic acid (HEDTA), $C_{10}H_{18}N_2O_7$, molecular weight 344.22, also known as N-[2-[bis(carboxymethyl)amino]-ethyl]-N-(2-hydroxyethyl)glycine; diethylene triamine pentaacetic acid (DTPA), $C_{14}H_{23}N_3O_{10}$, molecular weight 393.35, known also as pentetic acid, N,N-bis[-2-[bis(carboxymethyl)amino]ethyl]glycine; ethylene diamine tetraacetic acid (EDTA), $C_{10}H_{16}N_2O_8$, molecular weight 292.25, known also as edetic acid, N,N'-1,2-ethanediyl-bis[N-(carboxymethyl)glycine], havidote.

Amino-carboxylic acids and their salts form a class of multidentate chelating liquids which complex or coordinate metal ions. These compounds form very stable metal liquid complexes. Currently, EDTA, NTA, and DTPA are used as sequestering agents to remove trace metals, particularly in laboratory analyses. HEDTA is used as a laboratory sequestering agent, and NTA is also used as a builder of synthetic detergents. EDTA, in particular, is used for the quantification of calcium in analytical analyses, and has been used for such purposes as a treatment for heavy metals poisoning and as a water softening agent in cleaning products.

These amino-carboxylic ligands form complexes with $Ca+2$ ion, which are stable and can be isolated. They are also water soluble, allowing for their separation from hydrophobic phases. Amino-carboxylic acids and their salts will also complex other metal ions in aqueous solution, but appear to have little or no effect on the more commonly found, ordinary organometallic metal contaminants in petroleum, such as nickel and vanadium petroporphyrins. It may, however, have some effect on iron, and amino-carboxylic acids and their salts may be effective for removing organo-iron compounds.

The salt forms of amino-carboxylic acids can be generally formed in situ by the addition of most any strong base, and can be isolated in some cases, from the aqueous solution as crystalline salts. The salts are generally more water soluble, and less acidic than the free acids.

As discussed previously, in order for the calcium to bind appropriately to the amino-carboxylic acids, the pH should be above 2, and preferably 5 to 9. One difficulty with the addition of base, however, is the formation of emulsions which can interfere with effective separation. Therefore the most preferred pH is around 6, especially with naphthenic acid crudes.

The ratio of aqueous amino-carboxylic acid solution to hydrocarbonaceous feed should be optimized, with the determining factor being the separation method. Commercial desalters, for example, ordinarily run at 10% or less aqueous volume.

Countercurrent extraction may also be used for separation, and effective separations using that technique have been done at 50% or more aqueous volume. The contact time between the aqueous extraction solution and the hydrocarbonaceous feed may vary from between a few seconds to about 4 hours. The preferred contact time is from about 4 to about 60 seconds. The temperature at which the extraction takes places is also a factor in process efficiency. The preferred temperature is above 180° F., and more preferred 300° F. and above.

EXAMPLES

Example 1

In laboratory trials, the results of which are detailed in Table I below, an amount of San Joaquin Valley vacuum residuum (93 ppm Ca), as indicated, was dissolved in toluene to give a workable viscosity, and was mixed with the indicated amount of EDTA solution, which is the preferred chelating or sequestering agent, prepared by dissolving the appropriate amount of EDTA in deionized $H_2O$ to give the listed mole EDTA to mole Ca ratios, and the pH of which was adjusted to approximately 9 using ammonium hydroxide. A demulsifier, tradenamed treatolite L-1562, was added in those instances where indicated. The EDTA/crude mixture was shaken and allowed to separate, preferably overnight at room temperature, except where indicated. The residuum phase was analyzed before and after processing to obtain the percent of calcium removal as indicated. Comparative examples using a 10% solution of hydrochloric acid, a solution of ammonium hydroxide, and acid water were also performed, the results as indicated. Also an example was performed using Shengli crude as the feedstock, which is a crude from China having a small but significant amount of calcium. The results of the examples are shown in Table I below.

TABLE I

Ca REMOVAL FROM SAN JOAQUIN VALLEY VACUUM RESIDUUM (SJV-VR) BY EDTA

| Feed | g oil | Aqueous Media | Mole Ratio EDTA/Ca | Demulsifier | % Ca Removal | Temp. |
|---|---|---|---|---|---|---|
| SJV-VR | 20.4 | 160 ml EDTA | 1.2/1 | Yes | 91.7 | Room |
| SJV-VR | 21.1 | 160 ml EDTA | 2.2/1 | Yes | 99.6 | Room |
| SJV-VR | 22.0 | 160 ml EDTA | 5.3/1 | Yes | 99.7 | Room |
| SJV-VR | $7.95 \times 10^4$ | 55 gal EDTA | 16.5/1 | Yes | 97.4 | 180° F. |
| SJV-VR | 100.4 | 800 ml EDTA | 116/1 | No | 98.5 | Room |
| SJV-VR | 20.2 | 160 ml EDTA | 115/1 | No | 98.9 | Room |
| SJV-VR | $7.95 \times 10^4$ | 55 gal EDTA | 128/1 | Yes | 97.6 | 180° F. |
| SJV-VR | 102.5 | 900 ml 10% HCl | 0/1 | No | 7.0 | Room |
| SJV-VR | 20.5 | 160 ml $NH_4OH$ | 0/1 | No | 9.2 | Room |
| SJV-VR | 22.4 | 160 ml EDTA | 104/1 | Yes | 95.0 | Room |
| Shengli | 25.0 | 160 ml EDTA | 100/1 | No | 84.0 | Room |
| SJV-VR | 21.4 | Acidic Water | 200000/1 | No | 2.0 | Room |

Table I indicates that almost stoichiometric amounts of EDTA are all that are necessary for a good extraction on the order of 90% to 100%. In the extractions performed using acids, bases, or water, conversely, the percent of the calcium removal was very low.

EXAMPLE 2

Laboratory trials were performed the same as in Example 1 except the pH was adjusted to approximately 6 using ammonium hydroxide. This pH is more amenable for crudes having high naphthetic acid content. The results are detailed in Table II.

TABLE II

Ca REMOVAL BY EDTA OF SJV-VR AT pH 6

| pH | Mole EDTA / Mole Ca | Lbs EDTA / Bbl Residuum | % Ca Removal | % Aqueous Volume |
|---|---|---|---|---|
| 5.5 | 90 | 22.5 | 99 | 75 |
| 6.0 | 16.5 | 4.06 | 99 | 33 |
| 6.4 | 6.9 | 1.70 | 98 | 10 |
| 6.2 | 3 | 0.75 | 95 | 13 |
| 6.5 | 1 | 0.25 | 97 | 13 |

EXAMPLE 3

To establish the effect of aqueous volume in Ca removal, various aqueous to oil ratios were attempted and the results are listed in Table III.

TABLE III

Ca REMOVAL AS A FUNCTION OF AQUEOUS VOLUME

| % Aqueous Volume | Mole EDTA / Mole Ca | Lbs EDTA / Bbl Residuum | % Ca Removal |
|---|---|---|---|
| 66 | 2.2 | 0.54 | 99 |
| 33 | 16.5 | 4.06 | 99 |
| 13 | 3 | 0.74 | 95 |
| 10 | 6.9 | 1.70 | 97.7 |
| 2 | 6.9 | 1.70 | 93.5 |

To assess the demetalation of other metals by EDTA from the crudes, further comparative examples were run using EDTA mole equivalents of from 1 to about 130 which were analyzed for the percent removal of iron, nickel, vanadium, and magnesium. The effect of the EDTA on removal of these other metals is shown in FIG. 1.

EXAMPLE 4

To test other amino-carboxylic acids, further tests were conducted as above, the indicated amount of San Joaquin Valley vacuum residuum was dissolved in toluene, if necessary, to give a workable viscosity, and was mixed with a 10% aqueous volume of the indicated amino-carboxylic acid solution. The solution was prepared by dissolving the appropriate amount of the amino-carboxylic acid in deionized $H_2O$ to give 1.5 mole equivalents of agent to moles of Ca, and the pH was adjusted to 6 with ammonium hydroxide. A conventional demulsifier, tradenamed treatolite L-1562, was added. The amino-carboxylic acid solution and the oil mixtures was shaken and allowed to separate, preferably overnight at room temperature. The residuum was analyzed before and after treatment to determine the amount of calcium removed. Table IV lists the results. EDTA was also included for comparison. Calcium removal was excellent with these agents, i.e., the determination was at the lower detection limit of the calcium determination technique.

For comparison purposes, Table V lists calcium from San Joaquin Valley vacuum residuum by conventional desalting solutions. Little calcium removal activity is afforded by these agents.

TABLE IV

CALCIUM REMOVAL FROM SAN JOAQUIN VALLEY VACUUM RESIDUUM BY VARIOUS AMINO-CARBOXYLATES

| Agent | Ca Removal, % |
|---|---|
| Ethylene Diamine Tetraacetic Acid (EDTA) | 99 |
| Nitrilotriacetic ACID (NTA) | 93 |
| N—(Hydroxyethyl)Ethylene Diamine Triaacetic Acid (NEDTA) | 94 |
| Diethylene Triamine Pentaacetic Acid (DTPA) | 94 |

$\frac{\text{Mole Agent}}{\text{Mole Ca}}$ = 1.5, pH 6, 10% Aqueous Volume, 1 Min Reaction, Room Temp.

TABLE V

Ca REMOVAL BY CONVENTIONAL DESALTING AGENTS OF SJV-VR

| Agent | Mole Agent / Mole Ca | Aqueous Vol, % | Ca Removal, % |
|---|---|---|---|
| Hydrochloric Acid | 6,650 | 66 | 7.2 |
| Ammonium Hydroxide | large excess | 66 | 9.2 |
| Water | 200,000 | 16 | 0.2 |

To find an appropriate pH level for the process, runs were conducted using 1–5 eq EDTA in a 27% aqueous solution at various pH levels. The treated feedstock was analyzed for various metals levels. The results are indicated below in Table VI.

TABLE VI

METALS REMOVAL FROM SAN JOAQUIN VALLEY VACUUM RESIDUUM WITH EDTA AT LOW pH

| pH | Removal, % Ca | Fe | Ni | V |
|---|---|---|---|---|
| 4.5 | 99 | 35 | 4 | 3 |
| 3.5 | 99 | 35 | 5 | 4 |
| 2.5 | 94 | 41 | 5 | 5 |
| 1.0 | 37 | 35 | 8 | 7 |

1–1.5 eq EDTA 27% Aqueous Solution

What is claimed is:

1. An aqueous extraction method for demetalizing Group IIA metals from hydrocarbonaceous feedstock, said process comprising:

mixing said hydrocarbonaceous feedstock with an aqueous solution of a metals sequestering agent comprising amino carboxylic acids, salts thereof, or mixtures thereof; and separating the substantially demtalated hydrocarbonaceous feedstock from the aqueous solution; wherein the feedstock to be demetalated is selected from the group consisting of crude petroleum, atmospheric or vacuum residua, solvent deasphalted oil derived from these crudes or residua, shale oil, liquified coal, and tar snad effluent.

2. The method as claimed in claim 1 wherein the metal is calcium.

3. The method as claimed in claim 1 wherein the metals are organometallically-bound, non-porphyrin compounds.

4. The method as claimed in claim 3 wherein said compounds are compounds of calcium.

5. The method as claimed in claim 1 or 3 wherein the said metals sequestering agents are selected from the group consisting of nitrilotriacetic acid (NTA), N-(hydroxyethyl)ethylene diamine triacetic acid (HEDTA), diethylene triamine pentaacetic acid (DTPA), and ethylene diamine tetraacetic acid (EDTA) their salts, and mixtures thereof.

6. The method claimed in claim 5 wherein said metals sequestering agent is EDTA, its salts, or mixtures thereof.

7. The method as claimed in claim 1 wherein the pH of the mixing step is adjusted to 2 or above.

8. The method as claimed in claim 1 wherein the pH of the mixing step is adjusted to 5 or above.

9. The method as claimed in claim 1 where said separating is performed by a method selected from the group consisting of a conventional crude oil desalting process and countercurrent extraction.

* * * * *

UNITED STATES PATENT AND TRADEMARK OFFICE

CERTIFICATE OF CORRECTION

PATENT NO. : U.S. 4,778,590

DATED : October 18, 1988

INVENTOR(S) : John G. Reynolds and Thomas F. Finger

It is certified that error appears in the above-identified patent and that said Letters Patent are hereby corrected as shown below:

Claim 1, Col. 6, Line 48, "demtalated" should read--demetalated--

Claim 1, Col. 6, Line 54, "snad" should read --sand--

Signed and Sealed this

Fourteenth Day of March, 1989

*Attest:*

DONALD J. QUIGG

*Attesting Officer*

*Commissioner of Patents and Trademarks*